US007429888B2

(12) United States Patent
Owen

(10) Patent No.: US 7,429,888 B2
(45) Date of Patent: Sep. 30, 2008

(54) TEMPERATURE COMPENSATION FOR FLOATING GATE CIRCUITS

(75) Inventor: William H. Owen, Los Altos Hills, CA (US)

(73) Assignee: Intersil Americas, Inc., Milpitas, CA (US)

( * ) Notice: Subject to any disclaimer, the term of this patent is extended or adjusted under 35 U.S.C. 154(b) by 0 days.

(21) Appl. No.: 11/029,549

(22) Filed: Jan. 5, 2005

(65) Prior Publication Data

US 2005/0146377 A1 Jul. 7, 2005

Related U.S. Application Data

(60) Provisional application No. 60/534,550, filed on Jan. 5, 2004.

(51) Int. Cl.
*G05F 1/10* (2006.01)

(52) U.S. Cl. ..... 327/541; 327/513

(58) Field of Classification Search ..... 327/548, 327/540, 541, 538, 542, 543; 323/313, 312, 323/314

See application file for complete search history.

(56) References Cited

U.S. PATENT DOCUMENTS 4,935,702 A * 6/1990 Mead et al. ..... 330/9
4,953,928 A * 9/1990 Anderson et al. ..... 357/23.5
4,980,859 A * 12/1990 Guterman et al. ..... 365/154
5,059,920 A * 10/1991 Anderson et al. ..... 330/253
5,068,622 A * 11/1991 Mead et al. ..... 330/253
5,095,284 A * 3/1992 Mead ..... 330/253
5,166,562 A * 11/1992 Allen et al. ..... 307/571
5,875,126 A * 2/1999 Minch et al. ..... 365/185.01
5,986,927 A * 11/1999 Minch et al. ..... 365/185.1
6,118,384 A * 9/2000 Sheldon et al. ..... 340/636.15
6,133,780 A * 10/2000 Chi ..... 327/541
6,297,689 B1 * 10/2001 Merrill ..... 327/540
6,333,728 B1 * 12/2001 Libsch et al. ..... 345/90
6,414,536 B1 * 7/2002 Chao ..... 327/540
6,650,175 B2 * 11/2003 Messager ..... 327/541
6,686,797 B1 * 2/2004 Eker ..... 327/539
6,701,340 B1 * 3/2004 Gorecki et al. ..... 708/801

(Continued)

OTHER PUBLICATIONS

Fowler, et al., "Electron Emission in Intense Electric Fields",Royal Soc. Proc., A, vol. 119 (1928).*

(Continued)

*Primary Examiner*—N. Drew Richards
*Assistant Examiner*—Thomas J Hiltunen
(74) *Attorney, Agent, or Firm*—Nixon Peabody LLP

(57) ABSTRACT

A system and method is provided for improving the accuracy of the voltage reference output of a floating gate voltage reference circuit by minimizing the temperature coefficient, Tc. The system and method provides a minimized Tc on output reference voltage, for a wide variety of such output voltages. In a dual floating gate voltage reference circuit wherein a voltage reference output (Vref) is generated as a function of the difference in charge of said floating gates, a method includes causing each of the floating gates to change voltage substantially the same amount as a function of temperature such that, during a read mode of the reference circuit, the temperature coefficient, Tc, of the voltage reference output is substantially reduced. The system and method achieves very low Tc over a wide range of reference or comparator voltages using low cost analog test equipment and methods.

16 Claims, 14 Drawing Sheets

U.S. PATENT DOCUMENTS 6,768,371 B1 * 7/2004 Layton et al. ..... 327/540
6,847,551 B2 * 1/2005 Owen ..... 365/185.05
6,859,156 B2 * 2/2005 May et al. ..... 341/144
6,882,582 B2 * 4/2005 Sicard et al. ..... 365/189.09
6,940,740 B2 * 9/2005 Ueda et al. ..... 365/145
6,970,037 B2 * 11/2005 Sakhuja et al. ..... 327/543
7,061,308 B2 * 6/2006 Abadeer et al. ..... 327/543
7,102,438 B1 * 9/2006 Colleran et al. ..... 330/260
7,113,017 B2 * 9/2006 Owen ..... 327/333
7,149,123 B2 * 12/2006 Georgescu et al. ..... 365/185.24
7,193,264 B2 * 3/2007 Lande ..... 257/314
7,324,380 B2 * 1/2008 Negut et al. ..... 365/185.2

OTHER PUBLICATIONS

Lenzlinger, et al., "Fowler-Nordheim Tunneling into Thermally Grown $SiO_2$", Applied Physics, Vo. 40, No. 1 (Jan. 1969).*
Carley, "Trimming Analog Circuits Using Floating-Gate Analog MOS Memory", IEEE Journal of Solid-State Circuits, vol. 24, No. 6 (Dec. 1989).*
Hasler, et al. "Adaptive Circuits Using pFET Floating-Gate Devices", pp. 1-15 (undated).*
Figueroa, et al., "A Floating-Gate Trimmable High Resolution DAC in Standard 0.25 μm CMOS", Nonvolatile Semiconductor Memory Workshop, pp. 46-47 (Aug. 2001).*

* cited by examiner

| FIG. 4A | FIG. 4B |
|---|---|
| FIG. 4C | FIG. 4D |

| | A | B | C | D | E | F | G | H |
|---|---|---|---|---|---|---|---|---|
| 1 | **SIMPLIFIED DUAL FLOATING GATE REFERENCE TC MODEL** | | | | | | | |
| 2 | N+cap Tc model data (ppm) | | | | | | | |
| 3 | Vcap | Tc | | | | | | |
| 4 | –1 | –10 | | | | | | |
| 5 | 0 | –8 | | | | | | |
| 6 | 1 | –6 | | | | | | |
| 7 | 2 | –4 | | | | | | |
| 8 | 3 | –2 | | | | | | |
| 9 | 4 | 0 | | | | | | |
| 10 | 5 | 2 | | | | | | |
| 11 | N+ Cap Tc: | | 2 * Vc – 8 | | | (ppm/C) | | |
| 12 | | | | | | | | |
| 13 | C(25 + Del T)= C(25) x (1+ (Tc x Del T x 1E – 6)) | | | | | | | |
| 14 | | | | | | | | |
| 15 | Vref | Vset0 | Temp | Del T | Cr Tc | C1 Tc | Cfgr | Cfg1 |
| 16 | | | | | | | 10pF | 10pF |
| 17 | | | | | ppm/C | ppm/C | (pF) | (pF) |
| 18 | 1 | 2.5 | 25C | 0 | | | 10.000 | 10.000 |
| 19 | 1 | 2.5 | 125C | 100 | –5 | –3 | 9.995 | 9.997 |
| 20 | | | | | | | | |
| 21 | | | | | | | | |
| 22 | 2 | 3 | 25C | 0 | | | 10.000 | 10.000 |
| 23 | 2 | 3 | 125C | 100 | –6 | –2 | 9.994 | 9.998 |
| 24 | | | | | | | | |
| 25 | | | | | | | | |
| 26 | 3 | 3.5 | 25C | 0 | | | 10.000 | 10.000 |
| 27 | 3 | 3.5 | 125C | 100 | –7 | –1 | 9.993 | 9.999 |
| 28 | | | | | | | | |
| 29 | | | | | | | | |
| 30 | 4 | 4 | 25C | 0 | | | 10.000 | 10.000 |
| 31 | 4 | 4 | 125C | 100 | –8 | 0 | 9.992 | 10.000 |
| 32 | | | | | | | | |

FIG. 4A

| I | J | K | L | M | N |
|---|---|---|---|---|---|
| SIMPLIFIED DUAL FLOATING GATE REFERENCE TC MODEL | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| Qfgr | Qfg1 | Vcfgr | Vcfg1 | Vref Delta | Tc |
| Cfgr(Vset0−Vref) | Cfg1 x Vset0 | Qfgr/Cfgr | Q1/Cfg1 | Vfg1−Vfgr | |
| (pCoulombs) | (pCoulombs) | (V) | (V) | (mV) | (ppm/C) |
| 15.00 | 25.00 | 1.50000 | 2.50000 | | |
| 15.00 | 25.00 | 1.50075 | 2.50075 | | |
| | deltas (mV): | 0.75038 | 0.75023 | −0.0002 | 0.00 |
| | | | | | |
| 10.00 | 30.00 | 1.00000 | 3.00000 | | |
| 10.00 | 30.00 | 1.00060 | 3.00060 | | |
| | deltas (mV): | 0.60036 | 0.60012 | −0.0002 | 0.00 |
| | | | | | |
| 5.00 | 35.00 | 0.50000 | 3.50000 | | |
| 5.00 | 35.00 | 0.50035 | 3.50035 | | |
| | deltas (mV): | 0.35025 | 0.35004 | −0.0002 | 0.00 |
| | | | | | |
| 0.00 | 40.00 | 0.00000 | 4.00000 | | |
| 0.00 | 40.00 | 0.00000 | 4.00000 | | |
| | deltas (mV): | 0.00000 | 0.00000 | 0.0000 | 0.00 |

FIG. 4B

| | | | | | | | | |
|---|---|---|---|---|---|---|---|---|
| 33 | | | | | | | | |
| 34 | 5 | 4.5 | 25C | 0 | | | 10.000 | 10.000 |
| 35 | 5 | 4.5 | 125C | 100 | −9 | 1 | 9.991 | 10.001 |
| 36 | | | | | | | | |
| 37 | | | | | | | | |
| 38 | Vref | Vset0 | Temp | Del T | Cr Tc | C1 Tc | Cr | C1 |
| 39 | | | | | | | | |
| 40 | | | | | ppm | ppm | (pF) | (pF) |
| 41 | | | | | | | | |
| 42 | 5 | 3 | 25C | 0 | | | 10.000 | 10.000 |
| 43 | 5 | 3 | 125C | 100 | −12 | −2 | 9.988 | 9.998 |
| 44 | | | | | | | | |
| 45 | | | | | | | | |
| 46 | 5 | 3.5 | 25C | 0 | | | 10.000 | 10.000 |
| 47 | 5 | 3.5 | 125C | 100 | −11 | −1 | 9.989 | 9.999 |
| 48 | | | | | | | | |
| 49 | | | | | | | | |
| 50 | 5 | 4 | 25C | 0 | | | 10.000 | 10.000 |
| 51 | 5 | 4 | 125C | 100 | −10 | 0 | 9.990 | 10.000 |
| 52 | | | | | | | | |
| 53 | | | | | | | | |
| 54 | | | | | | | | |
| 55 | 5 | 4.5 | 25C | 0 | | | 10.000 | 10.000 |
| 56 | 5 | 4.5 | 125C | 100 | −9 | 1 | 9.991 | 10.001 |
| 57 | | | | | | | | |
| 58 | | | | | | | | |
| 59 | 5 | 5 | 25C | 0 | | | 10.000 | 10.000 |
| 60 | 5 | 5 | 125C | 100 | −8 | 2 | 9.992 | 10.002 |
| 61 | | | | | | | | |
| 62 | | | | | | | Set0 | |
| 63 | Vref | Set0 | Del | | | Vref | Delta Vfg1(mV) | |
| 64 | | | | | | 5 | 3 | 3.0 |
| 65 | | | | | | 5 | 3.5 | 2.0 |
| 66 | | | | | | 5 | 4 | 1.0 |
| 67 | | | | | | 5 | 4.5 | 0.0 |
| 68 | | | | | | 5 | 5 | −1.0 |
| 69 | | | | | | | | |

FIG. 4C

| | | | | | |
|---|---|---|---|---|---|
| | | | | | |
| −5.00 | 45.00 | −0.50000 | 4.50000 | | |
| −5.00 | 45.00 | −0.50045 | 4.49955 | | |
| | deltas (mV): | −0.45041 | −0.44996 | 0.0005 | 0.00 |
| | | | | | |
| Qfgr | Qfg1 | Vfgr | Vfg1 | Vref Delta | Tc |
| Cfgr(Vset0−Vref*Cr/Cfgr) | Vset0xCfg1 | Vrq+Vrv | Qfg1/Cfg1 | Vfg1−Vfgr | |
| (pCoulombs) | (pCoulombs) | (V) | (V) | (mV) | (ppm/C) |
| | | | | | |
| −20.00 | 30.00 | −2.00000 | 3.00000 | | |
| −20.00 | 30.00 | −2.00240 | 3.00060 | | |
| | deltas (mV): | −2.40288 | 0.60012 | 3.0030 | 6.01 |
| | | | | | |
| −15.00 | 35.00 | −1.50000 | 3.50000 | | |
| −15.00 | 35.00 | −1.50165 | 3.50035 | | |
| | deltas (mV): | −1.65182 | 3.50004 | 2.0019 | 4.00 |
| | | | | | |
| −10.00 | 40.00 | −1.00000 | 4.00000 | | |
| −10.00 | 40.00 | −1.00100 | 4.00000 | | |
| | deltas (mV): | −1.00100 | 0.00000 | 1.0010 | 2.00 |
| | | | | | |
| | | | | | |
| −5.00 | 45.00 | −0.50000 | 4.50000 | | |
| −5.00 | 45.00 | −0.50045 | 4.49955 | | |
| | deltas (mV): | −0.45041 | −0.44996 | 0.0005 | 0.00 |
| | | | | | |
| 0.00 | 50.00 | 0.00000 | 5.00000 | | |
| 0.00 | 50.00 | 0.00000 | 4.99900 | | |
| | deltas (mV): | 0.00000 | −0.99980 | −0.9998 | −2.00 |
| | | Vref | | | |
| Tc | | | Set0 | Tc | |
| 6.0 | | 1.00000 | 2.50000 | 0.0 | |
| 4.0 | | 2.00000 | 3.00000 | 0.0 | |
| 2.0 | | 3.00000 | 3.50000 | 0.0 | |
| 0.0 | | 4.00000 | 4.00000 | 0.0 | |
| −2.0 | | 5.00000 | 4.50000 | 0.0 | |
| | | | | | |

FIG. 4D

| | | | | | | | | | | |
|---|---|---|---|---|---|---|---|---|---|---|
| **DUAL FLOATING GATE REFERENCE TC MODEL** | | | | | | | | | | |
| Simple N+ Cap Tc Model Data (ppm) | | | | | | | | | | |
| V | Tc | | | | | | | | | |
| 0 | −8 | | | | | | | | | |
| 1 | −6 | | | | | | | | | |
| 2 | −4 | | | | | | | | | |
| 3 | −2 | | | | | | | | | |
| 4 | 0 | | | | | | | | | |
| 5 | 2 | | | | | | | | | |
| N+ Cap Tc: | | 2 * Vc − 8 | | | (ppm) | | | | | |
| Poly Cap Tc: | | | 20 | (ppm) | | | | | | |
| C(25+Del T)= C(25) x (1+1E−6 x Tc x Del T) | | | | | | | | | | |
| | | | | | | | | | | |
| Vref | Vset0 | Temp | Del T | Cr Tc | C1 Tc | Cr | Crp | C1 | C1p | Cfgr |
| | | | | | | 10pF | 2pF | 10pF | 2pF | Cr+Crp |
| | | | | ppm | ppm | (pF) | (pF) | (pF) | (pF) | (pF) |
| 1 | 2.5 | 25C | 0 | | | 10.000 | 2.000 | 10.000 | 2.000 | 12.000 |
| 1 | 2.5 | 125C | 100 | −5 | −3 | 9.995 | 2.004 | 9.997 | 2.004 | 11.999 |
| | | | | | | | | | | |
| | | | | | | | | | | |
| 2 | 3 | 25C | 0 | | | 10.000 | 2.000 | 10.000 | 2.000 | 12.000 |
| 2 | 3 | 125C | 100 | −6 | −2 | 9.994 | 2.004 | 9.998 | 2.004 | 11.998 |
| | | | | | | | | | | |
| | | | | | | | | | | |
| 3 | 3.5 | 25C | 0 | | | 10.000 | 2.000 | 10.000 | 2.000 | 12.000 |
| 3 | 3.5 | 125C | 100 | −7 | −1 | 9.993 | 2.004 | 9.999 | 2.004 | 11.997 |
| | | | | | | | | | | |
| | | | | | | | | | | |
| 4 | 4 | 25C | 0 | | | 10.000 | 2.000 | 10.000 | 2.000 | 12.000 |
| 4 | 4 | 125C | 100 | −8 | 0 | 9.992 | 2.004 | 10.000 | 2.004 | 11.996 |
| | | | | | | | | | | |
| | | | | | | | | | | |

| | |
|---|---|
| FIG. 6A | FIG. 6B |
| FIG. 6C | FIG. 6D |

FIG. 6A

| Cfg1 | Qfgr | Qfg1 | Vrq | Vrv | Vfgr | Vfg1 | Vref Delta | Tc |
|---|---|---|---|---|---|---|---|---|
| C1+C1p | Cfgr(Vset0−Vref*Cr/Cfgr) | Vset0xCfg1 | Qfgr/Cfgr | Vref*Cr/Cfgr | Vrq+Vrv | Q1/Cfg1 | Vfg1−Vfgr | |
| (pF) | (pCoulombs) | (pCoulombs) | (V) | (V) | (V) | (V) | (mV) | (ppm/C) |
| 12.000 | 20.00 | 30.00 | 1.6667 | 0.8333 | 2.5000 | 2.5000 | | |
| 12.001 | 20.00 | 30.00 | 1.6668 | 0.8330 | 2.4998 | 2.4998 | | |
| | | deltas (mV): | 0.1389 | −0.3473 | −0.2084 | −0.2083 | 0.0000 | 0.0 |
| | | | | | | | | |
| 12.000 | 16.00 | 36.00 | 1.3333E+00 | 1.6667E+00 | 3.0000 | 3.0000 | | |
| 12.002 | 16.00 | 36.00 | 1.3336E+00 | 1.6659E+00 | 2.9995 | 2.9995 | | |
| | | deltas (mV): | 0.2223 | −0.7223 | −0.5001 | −0.4999 | 0.0002 | 0.0 |
| | | | | | | | | |
| 12.000 | 12.00 | 42.00 | 1.0000E+00 | 2.5000E+00 | 3.5000 | 3.5000 | | |
| 12.003 | 12.00 | 42.00 | 1.0003E+00 | 2.4989E+00 | 3.4991 | 3.4991 | | |
| | | deltas (mV): | 0.2501 | −1.1253 | −0.8752 | −0.8748 | 0.0004 | 0.0 |
| | | | | | | | | |
| 12.000 | 8.00 | 48.00 | 6.6667E−01 | 3.3333E+00 | 4.0000 | 4.0000 | | |
| 12.004 | 8.00 | 48.00 | 6.6689E−01 | 3.3318E+00 | 3.9987 | 3.9987 | | |
| | | deltas (mV): | 0.2223 | −1.5561 | −1.3338 | −1.3329 | 0.0009 | 0.0 |

FIG. 6B

FIG. 6C

| | | | | | | | | | | |
|---|---|---|---|---|---|---|---|---|---|---|
| 5 | 4.5 | 25C | 0 | | | 10.000 | 2.000 | 10.000 | 2.000 | 12.000 |
| 5 | 4.5 | 125C | 10 | −9 | 1 | 9.991 | 2.004 | 10.001 | 2.004 | 11.995 |
| Vref | Vset0 | Temp | Del T | Crc | C1 Tc | Cr | Crp | C1 | C1p | Cfgr |
| | | | | ppm | ppm | (pF) | (pF) | (pF) | (pF) | C+Crp (pF) |
| 5 | 3 | 25C | 0 | | | 10.000 | 2.000 | 10.000 | 2.000 | 12.000 |
| 5 | 3 | 125C | 10 | 12 | −2 | 9.988 | 2.004 | 9.998 | 2.004 | 11.992 |
| 5 | 3.5 | 25C | 0 | | | 10.000 | 2.000 | 10.000 | 2.000 | 12.000 |
| 5 | 3.5 | 125C | 10 | 11 | −1 | 9.988 | 2.004 | 9.999 | 2.004 | 11.993 |
| 5 | 4 | 25C | 0 | | | 10.000 | 2.000 | 10.000 | 2.000 | 12.000 |
| 5 | 4 | 125C | 10 | −10 | 0 | 9.990 | 2.004 | 10.000 | 2.004 | 11.994 |
| 5 | 4.5 | 25C | 0 | | | 10.000 | 2.000 | 10.000 | 2.000 | 12.000 |
| 5 | 4.5 | 125C | 10 | −9 | 1 | 9.991 | 2.004 | 10.001 | 2.004 | 11.995 |
| 5 | 5 | 25C | 0 | | | 10.000 | 2.000 | 10.000 | 2.000 | 12.000 |
| 5 | 5 | 125C | 10 | 8 | 2 | 9.992 | 2.004 | 10.002 | 2.004 | 11.996 |
| Vref | Set0 | Del | | | Vref | S | Delta Vf (mV) | Delta Vg1 (mV) | Det ref | Set0 |
| 5 | 3.5 | | | | 5 | −1.8 | 1.2 | −2.4 | 0.8 | 4.5 |
| 5 | 5 | | | | 5 | 1.9 | | | | |

| | | | | | | | | |
|---|---|---|---|---|---|---|---|---|
| 12.000 | 4.00 | 54.00 | 0.33333 | 4.16667 | 4.5000 | 4.5000 | | |
| 12.005 | 4.00 | 54.00 | 0.33347 | 4.16465 | 4.4981 | 4.4981 | | |
| | | deltas (mV): | 0.1389 | −2.0147 | −1.8758 | −1.8742 | 0.0016 | 0.0 |
| | | | | | | | | |
| Cfg1 | Qfgr | Qfg1 | Vrq | Vrv | Vfgr | Vfg1 | Vref Delta | Tc |
| C1+C1p | Cfgr(Vset0−Vref*Cr/Cfgr) | Vset0xCfg1 | Qfgr/Cfgr | Vref*Cr/Cfgr | Vrq+Vrv | Qfg1/Cfg1 | Vfg1−Vfgr | |
| (pF) | (pCoulombs) | (pCoulombs) | (V) | (V) | (V) | (V) | (m/V) | (ppm/C) |
| | | | | | | | | |
| 12.000 | −14.00 | 36.00 | −1.1667E+00 | 4.1667E+00 | 3.0000 | 3.0000 | | |
| 12.002 | −14.00 | 36.00 | −1.1674E+00 | 4.1644E+00 | 2.9970 | 2.9995 | | |
| | | deltas (mV): | −0.7783 | −2.0147 | −3.0020 | −0.4999 | 2.5021 | 5.0 |
| | | | | | | | | |
| 12.000 | −8.00 | 42.00 | −6.6667E−01 | 4.1667E+00 | 3.5000 | 3.5000 | | |
| 12.003 | −8.00 | 42.00 | −6.6706E−01 | 4.1645E+00 | 3.4975 | 3.4991 | | |
| | | deltas (mV): | −0.3891 | −2.1540 | −2.5432 | −0.8748 | 1.6684 | 3.3 |
| | | | | | | | | |
| 12.000 | −2.00 | 48.00 | −1.6667E−01 | 4.1667E+00 | 4.0000 | 4.0000 | | |
| 12.004 | −2.00 | 48.00 | −1.6675E−01 | 4.1646E+00 | 3.9978 | 3.9987 | | |
| | | deltas (mV): | −0.0834 | −2.0844 | −2.1678 | −1.3329 | 0.8349 | 1.7 |
| | | | | | | | | |
| 12.000 | 4.00 | 54.00 | 3.3333E−01 | 4.1667E+00 | 4.5000 | 4.5000 | | |
| 12.005 | 4.00 | 54.00 | 3.3347E−01 | 4.1647E+00 | 4.4981 | 4.4981 | | |
| | | deltas (mV): | 0.1389 | −2.0147 | −1.8758 | −1.8742 | 0.0016 | 0.0 |
| | | | | | | | | |
| 12.000 | 10.00 | 60.00 | 8.3333E−01 | 4.1667E+00 | 5.0000 | 5.0000 | | |
| 12.006 | 10.00 | 60.00 | 8.3361E−01 | 4.1647E+00 | 4.9983 | 4.9975 | | |
| | | deltas (mV): | 0.2779 | −1.9451 | −1.6672 | −2.4988 | −0.8316 | −1.7 |
| | | | | | | | | |
| Tc (ppm/C) | | Vref | | | Set0 | Tc | | |
| 5.0 | | 1 | | | 2.5 | 0.0 | | |
| 3.3 | | 2 | | | 3 | 0.0 | | |
| 1.7 | | 3 | | | 3.5 | 0.0 | | |
| 0.0 | | 4 | | | 4 | 0.0 | | |
| −1.7 | | 5 | | | 4.5 | 0.0 | | |

FIG. 6D

TEMPERATURE COMPENSATION FOR FLOATING GATE CIRCUITS

CROSS REFERENCE TO RELATED APPLICATION

This application claims the benefit of U.S. Provisional Application No. 60/534,550 filed Jan. 5, 2004.

FIELD OF THE INVENTION

The invention relates generally to the field of circuit design and in particular to improving the accuracy of a floating gate voltage reference circuit.

BACKGROUND OF THE INVENTION

Programmable analog floating gate circuits have been used since the early 1980's in applications that only require moderate absolute voltage accuracy over time, e.g., an absolute voltage accuracy of 100-200 mV over time. Such devices are conventionally used to provide long-term non-volatile storage of charge on a floating gate. A floating gate is an island of conductive material that is electrically isolated from a substrate but capacitively coupled to the substrate or to other conductive layers. Typically, a floating gate forms the gate of an MOS transistor that is used to read the level of charge on the floating gate without causing any leakage of charge therefrom.

Various means are known in the art for introducing charge onto a floating gate and for removing the charge from the floating gate. Once the floating gate has been programmed at a particular charge level, it remains at that level essentially permanently, because the floating gate is surrounded by an insulating material which acts as a barrier to discharging of the floating gate. Charge is typically coupled to the floating gate using hot electron injection or electron tunneling. Charge is typically removed from the floating gate by exposure to radiation (UV light, x-rays), avalanched injection, or Fowler-Nordheim electron tunneling. The use of electrons emitted from a cold conductor was first described in an article entitled *Electron Emission in Intense Electric Fields* by R. H. Fowler and Dr. L. Nordheim, Royal Soc. Proc., A, Vol. 119 (1928). Use of this phenomenon in electron tunneling through an oxide layer is described in an article entitled *Fowler-Nordheim Tunneling into Thermally Grown* $SiO_2$ by M. Lenzlinger and E. H. Snow, Journal of Applied Physics, Vol. 40, No. 1 (January, 1969), both of which are incorporated herein by reference. Such analog floating gate circuits have been used, for instance, in digital nonvolatile memory devices and in analog nonvolatile circuits including voltage reference, Vcc sense, and power-on reset circuits.

FIG. 1A is a schematic diagram that illustrates one embodiment of an analog nonvolatile floating gate circuit implemented using two polysilicon layers formed on a substrate and two electron tunneling regions. FIG. 1A illustrates a cross-sectional view of an exemplary prior art programmable voltage reference circuit 70 formed on a substrate 71. Reference circuit 70 comprises a Program electrode formed from a first polysilicon layer (poly1), an Erase electrode formed from a second polysilicon layer (poly2), and an electrically isolated floating gate comprised of a poly1 layer and a poly2 layer connected together at a corner contact 76. Typically, polysilicon layers 1 and 2 are separated from each other by a thick oxide dielectric, with the floating gate fg being completely surrounded by dielectric. The floating gate fg is also the gate of an NMOS transistor TØ shown at 73, with a drain D and a source S that are heavily doped n+ regions in substrate 70, which is P type. The portion of dielectric between the poly1 Program electrode and the floating gate fg, as shown at 74, is a program tunnel region (or "tunnel device") TP, and the portion of dielectric between the polyl floating gate fg and the poly2 erase electrode, shown at 75, is an erase tunnel region TE. Both tunnel regions have a given capacitance. Since these tunnel regions 74,75 are typically formed in thick oxide dielectric, they are generally referred to as "thick oxide tunneling devices" or "enhanced emission tunneling devices." Such thick oxide tunneling devices enable the floating gate to retain accurate analog voltages in the +/−4 volt range for many years. This relatively high analog voltage retention is made possible by the fact that the electric field in most of the thick dielectric in tunnel regions 74,75 remains very low, even when several volts are applied across the tunnel device. This low field and thick oxide provides a high barrier to charge loss until the field is high enough to cause Fowler-Nordheim tunneling to occur. Finally, reference circuit 70 includes asteering capacitor CC that is the capacitance between floating gate fg and a different n+ region formed in the substrate that is connected to a Cap electrode.

FIG. 1B is a schematic diagram that illustrates a second embodiment of a floating gate circuit 70 that is implemented using three polysilicon layers. The three polysilicon floating gate circuit 70' is similar to the two polysilicon embodiment except that, for example Erase electrode is formed from a third polysilicon layer (poly 3). In addition, the floating gate fg is formed entirely from a poly2 layer. Thus, in this embodiment there is no need for a corner contact to be formed between the poly1 layer portion and the poly2 layer portion of floating gate fg, which is required for the two polysilicon layer cell shown in FIG. 1A.

Referring to FIG. 2, shown at 25 is an equivalent circuit diagram for the voltage reference circuit 70 of FIG. 1A and 70' of FIG. 1B. For simplicity, each circuit element of FIG. 2 is identically labeled with its corresponding element in FIGS. 1A and 1B.

Setting reference circuit 70 to a specific voltage level is accomplished using two separate operations. Referring again to FIG. 1A, the floating gate fg is first programmed or "reset" to an off condition. The floating gate fg is then erased or "set" to a specific voltage level. Floating gate fg is reset by programming it to a net negative voltage, which turns off transistor TØ. This programming is done by holding the Program electrode low and ramping the n+ bottom plate of the relatively large steering capacitor CC to 15 to 20V via the Cap electrode. Steering capacitor CC couples the floating gate fg high, which causes electrons to tunnel through the thick oxide at 74 from the poly1 Program electrode to the floating gate fg. This results in a net negative charge on floating gate fg. When the bottom plate of steering capacitor CC is returned to ground, this couples floating gate fg negative, i.e., below ground, which turns off the NMOS transistor TØ.

To set reference circuit 70 to a specific voltage level, the n+ bottom plate of steering capacitor CC, the Cap electrode, is held at ground while the Erase electrode is ramped to a high voltage, i.e., 12 to 20V. Tunneling of electrons from floating gate fg to the poly2 Erase electrode through the thick oxide at 75 begins when the voltage across tunnel device TE reaches a certain voltage, which is typically approximately 11V. This tunneling of electrons from the fg through tunnel device TE increases the voltage of floating gate fg. The voltage on floating gate fg then "follows" the voltage ramp coupled to the poly2 Erase electrode, but at a voltage level offset by about 11V below the voltage on the Erase electrode. When the voltage on floating gate fg reaches the desired set level, the voltage ramp on poly2 Erase electrode is stopped and then pulled back down to ground. This leaves the voltage on floating gate fg set at approximately the desired voltage level.

As indicated above, reference circuit 70 meets the requirements for voltage reference applications where approximately 200 mV accuracy is sufficient. The accuracy of circuit 70 is limited for two reasons. First, the potential on floating gate fg shifts down about 100 mV to 200 mV after it is set due to the capacitance of erase tunnel device TE which couples floating gate fg down when the poly2 Erase electrode is pulled down from a high voltage to ØV. The amount of this change depends on the ratio of the capacitance of erase tunnel device TE to the rest of the capacitance of floating gate fg (mostly due to steering capacitor CC), as well as the magnitude of the change in voltage on the poly2 Erase electrode. This voltage "offset" is well defined and predictable, but always occurs in such prior art voltage reference circuits because the capacitance of erase tunnel device TE cannot be zero. Second, the accuracy of circuit 70 is also limited because the potential of floating gate fg changes another 100 mV to 200 mV over time after it is set due to various factors, including detrapping of the tunnel devices and dielectric relaxation of all the floating gate fg capacitors.

Applications that require increased absolute voltage accuracy generally use a bandgap voltage reference. A bandgap voltage reference typically provides approximately 25 mV absolute accuracy over time and temperature, but can be configured to provide increased accuracy by laser trimming or $E^2$ digital trimming at test. While a bandgap voltage reference provides greater accuracy and increased stability over the prior art voltage reference circuits discussed above, a bandgap voltage reference only provides a fixed voltage of about 1.2V. Therefore, additional circuitry, such as an amplifier with fixed gain, is needed to provide other reference voltage levels. Moreover, prior art bandgap voltage references typically draw a relatively significant current, i.e., greater than 10 μA.

One of the key performance parameters for precision voltage references and comparators is the temperature coefficient, Tc, which indicates how much the voltage reference output (Vref) changes over a given temperature range. Tc for a given part may be positive, negative, or may change direction over various temperature ranges. A commonly accepted method of specifying Tc for voltage references is the "Box Method". The Box Method uses the maximum voltage and the minimum voltage of the reference voltage generated within a given temperature range, regardless of the specific temperature at which the minimum or maximum occurs in the range. This method is independent of the polarity or change in polarity of Tc within the specified temperature range. Usually expressed in ppm/C, i.e., ppm per degree C., $Tc=10^6\times(Vmax-Vmin)/(Vref\times(Tmax-Tmin))$, where Vmax is the maximum voltage, Vmin is the minimum voltage, Vref is the voltage reference output, Tmax is the maximum temperature in the specified temperature range, Tmin is the minimum temperature in the range, and 1 ppm/C is $10^{-6}$.

Voltage references and comparators based on bandgap and buried zener devices typically have temperature coefficients in the 10 to 20 ppm per degree C. range using this industry standard box method of measuring Tc. For a typical bandgap voltage of 1.25V and the industrial temperature range of −40 C to +85 C, a Tc=10 ppm/deg C means the output reference voltage can vary as much a $10^{-5}\times1.25V\times125$ C=1.56 mV over the full temperature range. If this bandgap voltage is amplified by 4 to make a 5V reference, the output reference voltage can change up to 6.2 mV over the full temperature range.

Various circuit and testing techniques are used to reduce Tc. These include special circuits and devices used during test such as laser trimming, nonvolatile trimming bits, or correction table stored in nonvolatile memory. Since the temperature variation of these devices is not linear, the compensation circuits used to reduce Tc are, by necessity, also non-linear, become quite complex, and require significant test time and equipment to achieve <5 ppm per degree C. The buried zener devices provide a higher reference voltage, such as 4 to 8 volts with a lower Tc. The Tc of a 5V reference using a zener device is much lower because the amplifier gain is 1 or less, so the zener Tc is not amplified. However the Tc of zener devices is quite nonlinear, so the cost of the special nonlinear trimming circuits, test equipment and test time required to trim the Tc of a zener based reference in order to achieve <1 or 2 ppm per degree C. is quite high.

An object of the present invention is to provide a voltage reference or comparator based on charge on a floating gate where the Tc can be adjusted to a minimum level. Another object of the present invention is to provide a very low Tc over a wide range of reference or comparator voltages. Another object of the present invention is to show how the Tc of a floating gate reference can be adjusted using standard, low cost analog test equipment and methods.

The voltage of a floating gate equals the charge level on the floating gate divided by the total capacitance of the floating gate. The fundamental basis for floating gate memory technology as well as for floating gate analog devices is that the charge level on a floating gate has been proven to be very constant over many years. For example, nonvolatile memories using thick oxide tunneling devices have been produced for many years with data retention specified at more than a 100 years based on very high temperature charge loss studies. Other studies have indicated the charge loss on some flash cells is as low as a few electrons per year. Thus, the primary cause of change in a floating gate's voltage with temperature is due to the change in the floating gate's capacitance.

The Tc of a voltage reference or comparator circuit based on a floating gate also depends on the Tc of the circuit, including the Floating Gate MOS transistor threshold and mobility, the Tc of the floating gate voltage. To a first order of magnitude, the Tc of the floating gate transistor threshold and mobility can be compensated by using a differential stage with either two matched floating gate transistors or a second input transistor that matches the floating gate. Using well known design and layout techniques, a MOS differential stage with Tc less than 1 or 2 ppm/C can be achieved.

The total floating gate capacitance is made up of several capacitors, the MOS transistor gate to channel capacitor, source and drain overlap capacitors, the coupling or steering capacitor, tunnel device capacitors, and various parasite capacitors such as floating gate to substrate metal or other poly layers. To a first order of magnitude, the Tc of the total floating gate capacitance is the sum of the Tc of each floating gate capacitor times the amount of capacitance divided by the total capacitance:

$$Tc=(Tc1\times C1+Tc2\times C2+Tc3\times C3+\ldots)/Cfg\ \text{total}.$$

The Tc for each of the floating gate capacitors varies from process to process and depends on many factors such as the dielectric material and thickness, the temperature expansion coefficient of the underlying silicon, the doping level and profile of each of the capacitor plates, and the difference in DC voltage on the capacitor plates. The change in capacitance with DC voltage and with temperature is caused primarily by depletion effects in the semiconductor plates of the capacitor. Depletion or space charge effects in semiconductors create $2^{nd}$ and $3^{rd}$ capacitors in series with the dielectric capacitor which change with temperature and the polarity and magnitude of the field in the semiconductor.

The amount of change in capacitance of a capacitor with voltage is called the Voltage Coefficient (Vc). For many types of semiconductor capacitors, the Vc coefficient is quite non-linear. The amount of change in capacitance with temperature, Tc, of a semiconductor capacitor varies significantly depending on the type of capacitor and also changes with the DC voltage. A typical floating gate EEPROM technology has 2 layers of polysilicon as well as an N+ diffusion coupling capacitor to the floating gate. In one EEPROM technology, the Tc of the poly-poly capacitor is about 20 ppm/deg C and the voltage coefficient is nearly 0. The Tc of one type of N+ diffusion to floating gate capacitor varies from −40 ppm/C to +0 ppm/C for DC voltages from 0 to +6 volts and the Vc is positive and varies from 100 to 10 ppm per volt in the 0 to +6 volt range. For another type of N+ diffusion to floating gate capacitor, Tc varies from −7 ppm/C to +7 ppm/C and the Vc varies from +100 to +10 ppm for DC voltages from 0 to +6 volts.

One method to achieve low Tc for a floating gate capacitor is to use capacitors with positive Tcs to compensate for capacitors with negative Tcs. For example, a poly-poly capacitor with a +20 ppm/C Tc can be used to balance out a coupling capacitor with −4 ppm/C Tc by making a coupling capacitor with 5 times more capacitance than the poly-poly capacitor. By making the poly-poly capacitor combined with the 5× coupling capacitor much larger than the rest of the floating gate capacitors, the Tc of the total floating gate capacitance can be made very low. Due to the change in Tc with applied DC voltage, the lowest Tc will be achieved for this method only at one specific DC voltage. In other words, for a given floating gate technology, a selection of types and sizes of floating gate capacitors can be made that will provide the lowest Tc at one specific DC voltage.

What is needed is a system and method for compensating for and thus minimizing Tc for a range of DC voltages so as to improve he accuracy of the output voltage (Vref) of a floating gate voltage reference.

SUMMARY OF THE INVENTION

The present invention provides a system and method for minimizing Tc in a high precision floating gate voltage reference circuit. An object of the present invention is to provide Tc compensation for a range of voltages.

Broadly stated, the present invention provides, in a dual floating gate voltage reference circuit wherein a voltage reference output (Vref) is generated as a function of the difference in charge of the floating gates, a method for improving the accuracy of Vref as a function of temperature, comprising causing each of the floating gates to change voltage substantially the same amount as a function of temperature such that, during a read mode of the reference circuit, the temperature coefficient, Tc, of the voltage reference output is substantially reduced.

Broadly stated, the present invention also provides, in a dual floating gate voltage reference circuit wherein a voltage reference output (Vref) is generated as a function of the difference in charge of the floating gates, a method for improving the accuracy of Vref as a function of temperature comprising selecting a desired Vref, wherein Vref is any voltage in a predetermined range; determining a common mode voltage (Set0) voltage for the selected Vref such that the temperature characteristics of each floating gate are substantially matched; and using the Set0 voltage in a set mode of the voltage reference circuit.

Broadly stated, the present invention also provides a dual floating gate reference circuit for improving the accuracy of a voltage reference output (Vref) as a function of temperature, wherein Vref is generated as a function of the difference in charge on the floating gates, comprising a first floating gate for storing charge thereon; a second floating gate for storing charge thereon; a first capacitor coupled to the first floating gate; a second capacitor coupled to the second floating gate; wherein the reference circuit is arranged such that the floating gates are programmable during a set mode so as to cause each of the floating gates to change voltage substantially the same amount as a function of temperature during a read mode such that the temperature coefficient, Tc, of the voltage reference output is substantially reduced.

These and other embodiments, features, aspects, and advantages of the invention will become better understood with regard to the following description, appended claims and accompanying drawings.

BRIEF DESCRIPTION OF THE DRAWINGS

FIG. 4 is a spreadsheet/chart of the Tc model for the embodiment of FIG. 2, and is comprised of four parts 4A, 4B, 4C, and 4D referred to herein collectively as FIG. 4;

FIG. 6 is a chart of the Tc model for the embodiment in FIG. 5, and is comprised of four parts 6A, 6B, 6C, and 6D referred to herein collectively as FIG. 6.

DETAILED DESCRIPTION OF THE INVENTION

The present invention is a system and method for improving the accuracy of the output reference voltage ($V_{ref}$) of a floating gate voltage reference circuit as a function of temperature. An object of the present invention is minimizing Tc in a high precision dual floating gate voltage reference circuit.

Figure 1A:
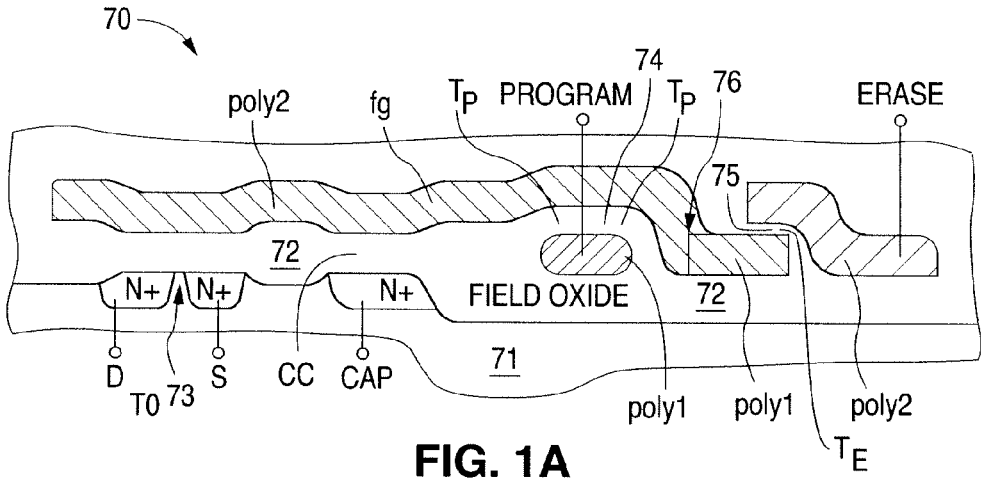
FIG. 1A (Prior Art)
FIG. 1A is a schematic diagram that illustrates a cross-sectional view of a prior art programmable floating gate circuit formed from two polysilicon layers.
Figure 1B:
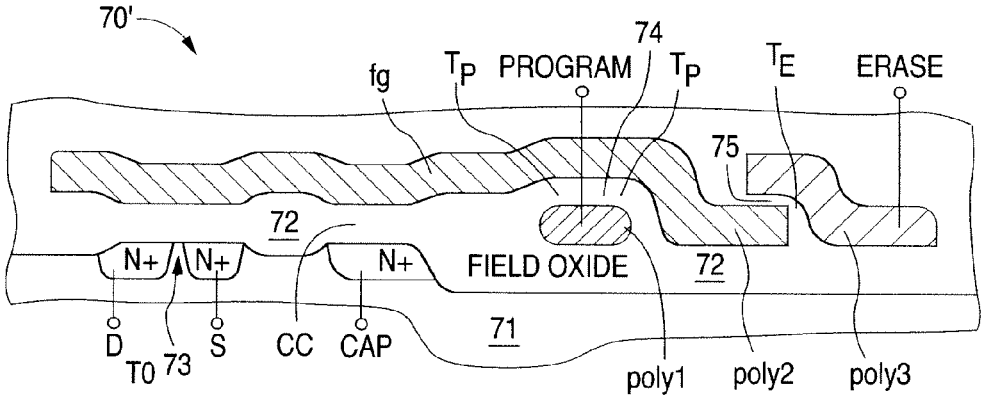
FIG. 1B (Prior Art)
FIG. 1B is a similar prior art floating gate circuit formed from three polysilicon layers.
Figure 1C:
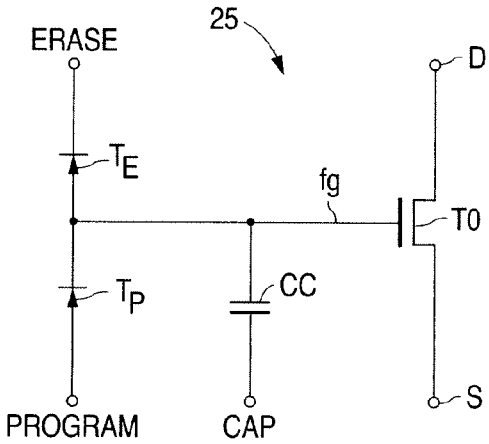
FIG. 1C (Prior Art)
FIG. 1C is an equivalent circuit diagram for the reference circuit illustrated in FIGS. 1A and 1B.
Figure 1D:
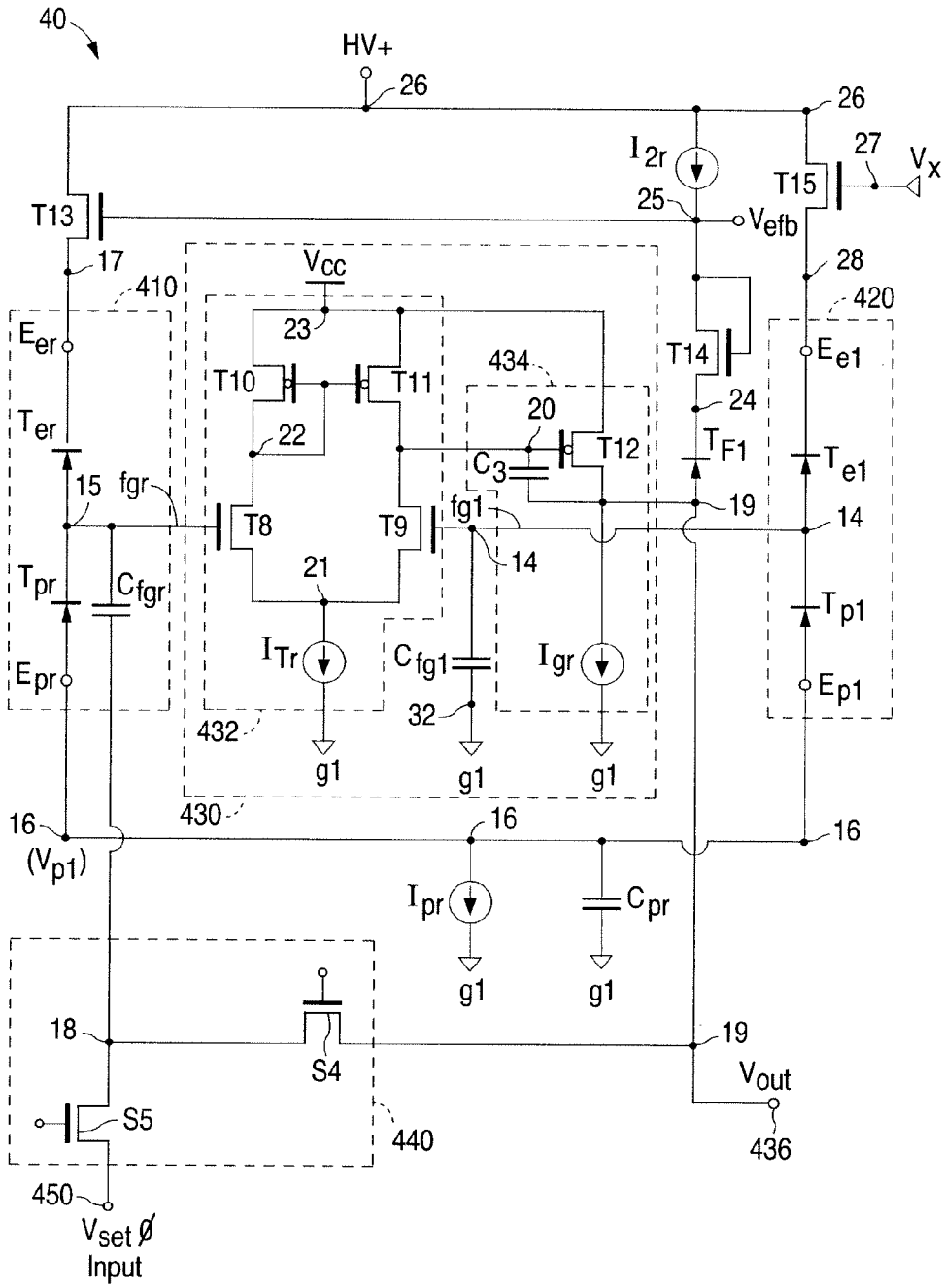
FIG. 1D (Prior Art)
FIG. 1D is a circuit diagram of a prior art differential dual floating gate circuit for programming a charge on a floating gate in a set mode and for generating a high precision reference voltage in a read mode.
Figure 1E:
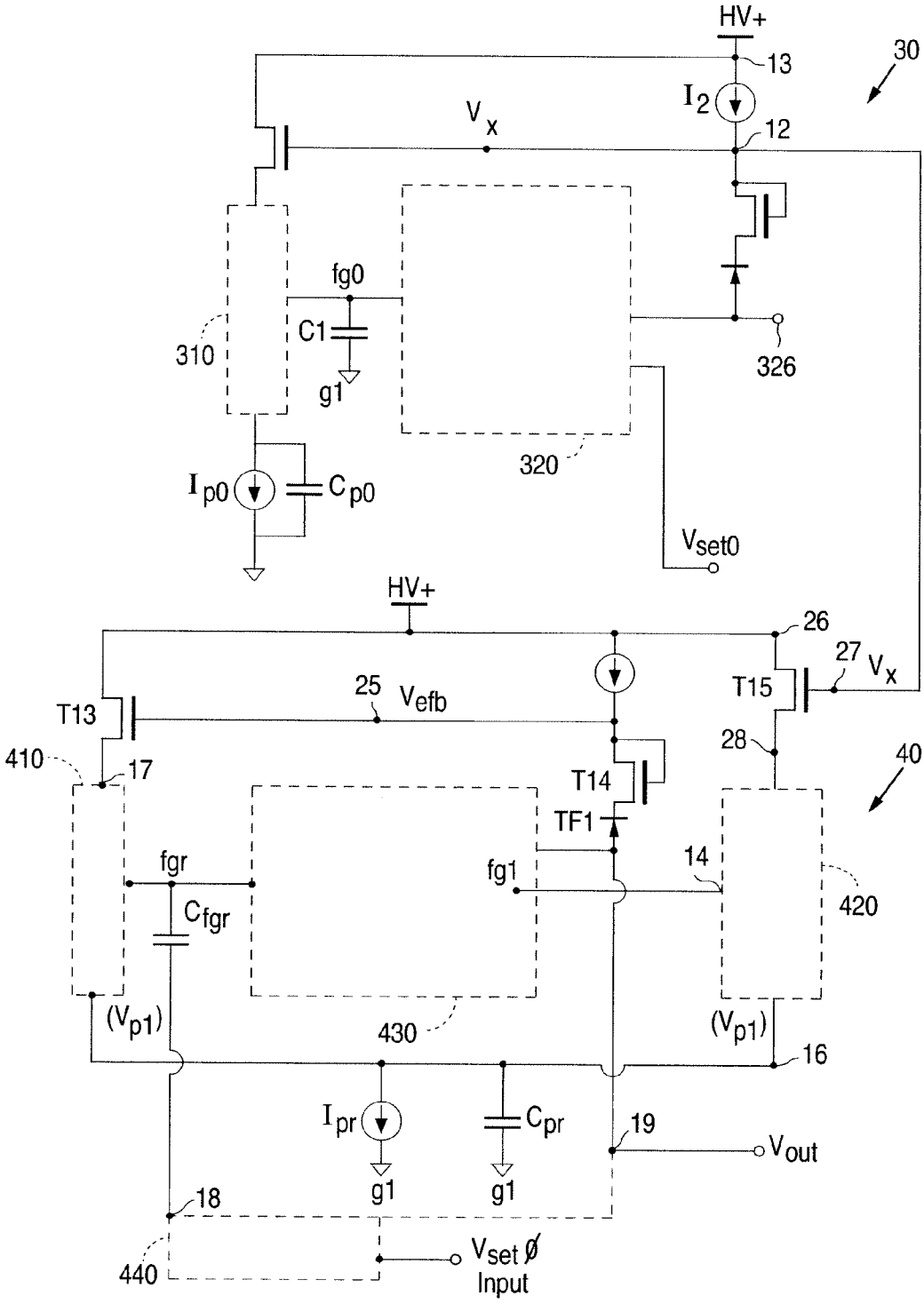
FIG. 1E (Prior Art)
FIG. 1E is a combined schematic and block diagram illustrating a single floating gate circuit coupled to the dual floating gate circuit to enable precise programming of the floating gate during a set mode.

Methods of setting a reference voltage in a dual floating gate circuit are known to one skilled in the art as described in further detail in commonly assigned applications including U.S. Patent Application Publication US 2004/0145949 for application Ser. No. 10/353,403, now U.S. Pat. No. 6,847,551 and incorporated by reference herein. FIGS. 1D and 1E and the description included below from that application describe a method of setting a reference voltage in a dual floating gate circuit. FIG. 1D is a circuit diagram of a prior art differential dual floating gate circuit 40 for programming a charge on a floating gate in a set mode and for generating a high precision reference voltage in a read mode. Circuit 40 preferably comprises a reference floating gate fgr at a node 15 and a second floating gate fgl at a node 14. At the conclusion of a set mode, both floating gates fgr and fgl are programmed, respectively, to charge levels such that the difference in charge level between fgr and fgl is a function of an input set.voltage capacitively coupled to fgr during the set mode. Thereafter, during a read mode, circuit 40 may be configured as a voltage reference circuit such that an output reference voltage isgenerated that is a function of the input set voltage and is preferably equal to the input set voltage. The set mode may be instituted at the factory to cause fgr and fgl to be set to their respective desired charge levels, and thereby, to cause circuit 40 to generate a desired output reference voltage whenever circuit 40 is later caused to enter its read mode. Alternatively, a later user of circuit 40 can cause circuit 40 to enter a set mode whenever the user wishes, to thereby update the difference in charge levels between fgr and fgl as a function of the input set voltage, and thus to update the output reference voltage generated by circuit 40 during a subsequent read mode.

The sequence used to program floating gates fgr and fgl in circuit 40 is as follows. In order to set the voltage on fgl, a voltage Vx is coupled at a node 27 to the gate of a transistor T15 in circuit 40, such that Vfgl is set to Vx-1Vt-1TV, where 1 Vt is the threshold voltage of transistor T15 and 1TV is the tunnel voltage of an erase tunnel device Tel.

In a preferred embodiment, Vx is generated by a second floating gate voltage reference circuit, e.g., circuit 30. FIG. 1E is a combined schematic and block diagram illustrating this embodiment for precisely programming fgr during a set mode. Circuit 40 in FIG. 1E is identical to the circuit illustrated in FIG. 1D. In the embodiment shown in FIG. 1E, a high voltage set cycle is performed on both the single floating gate differential circuit 30 and the dual floating gate differential reference circuit 40 at the same time. During the set mode, circuit 30 generates the voltage at node 12 such that floating gate fgØ is set as described earlier, wherein VsetØ for circuit 30 is an internally or externally supplied predetermined voltage, such as +4v. Floating gate fgl is therefore set to a voltage that is a predetermined function of the voltage on floating gate fgØ, and is preferably set to be approximately equal to VfgØ assuming the tunnel devices in both differential circuits, i.e., circuits 30 and 40, are reasonably well matched. The voltage set on floating gate fgl is then used to set the voltage on floating gate fgr, such that Vfgr is a predetermined function of Vfgl, and preferably approximately equal to Vfgl, as described in greater detail below.

Circuit 40 further comprises a circuit 410 that includes: a programming tunnel device Tpr formed between floating gate fgr and a programming electrode Epr, at a node 16; an erase tunnel device Ter formed between floating gate fgr and an erase electrode Eer, at a node 17; and a steering capacitor Cfgr coupled between floating gate fgr and a node 18. Circuit 40 also comprises a circuit 420 that includes: a programming tunnel device Tpl formed between floating gate fgl and a programming electrode Epl, at node 16, and an erase tunnel device Tel formed between floating gate fgl and an erase electrode Eel, at a node 28. Preferably, programming electrodes Epr and Epl receive a negative voltage during the set mode, and erase electrodes Eer and Eel receive a positive voltage during the set mode. Moreover, tunnel devices Tpr, Tpl, Ter and Tel are preferably Fowler-Nordheim tunnel devices that are reasonably well matched as a result of their chip layout, and these tunnel devices are ideally reasonably well matched with tunnel devices TpØ and TeØ of circuit 30.

Also included in circuit 40 is a steering capacitor Cfgl coupled between floating gate fgl and a node 32. The bottom plate of steering capacitor Cfgl is coupled to a predetermined voltage during the set mode that is preferably ground gl. Steering capacitor Cfgl is used to provide a stable ground reference for floating gate fgl. Circuit 40 also includes a transistor T15 that has its drain coupled to a high voltage supply HV+, at a node 26, its source coupled to node 28, and its gate coupled to node 27.

Setting a voltage on floating gate fgr during the set mode is achieved by taking electrode Epr negative and electrode Eer positive such that the voltage at node 17 minus the voltage at node 16 is two tunnel voltages or approximately 22V. The dual conduction current at 22V is typically approximately one to two nanoamps. An alternative is to create a sufficient voltage differential across electrode Epr and electrode Eer to generate a current flow of approximately 5 nA from node 16 to node 17. In either case, both tunnel devices are conducting, i.e., the tunnel devices are in "dual conduction." By operating in dual conduction, the voltage on the floating gate fgr can stabilize at a DC voltage level for as long a time as needed to enable circuit 40 to end the set mode process in a controlled fashion such that the voltage on floating gate fgr settles to a very precise and accurate level. Operating in dual conduction with feedback through at least one of the tunnel devices is key to making it possible to set the floating gate fgr voltage very accurately.

In dual conduction, the tunnel devices Ter and Tpr, which are reasonably well matched by layout, will modify the charge level on floating gate fgr by allowing electrons to tunnel onto and off of floating gate fgr so as to divide the voltage between nodes 17 and 16 in half. Thus, the floating gate voltage, i.e., the voltage at node 15, will be Vfgr=Vnode 16+(Vnode 17−Vnode 16)/2, which is half way between the voltage at node 17 and the voltage at node 16. Under these conditions, the dual conduction current can typically charge or discharge node 15, which typically has less than 1.0 pF capacitance, in less than 1 mSec. As this occurs, the floating gate voltage "tracks" directly with the voltage at nodes 16 and 17 and settles to a DC voltage that is half way between those two voltages in a few mSec. Accordingly, Vfgr can be set to a positive or negative voltage or zero volts depending upon the value of the voltages existing at electrodes Eer and Epr. For example, if the tunnel voltage is approximately 11V for the erase and program tunnel devices Ter and Tpr, and the voltage at electrode Eer is set to about +16V and the voltage at electrode Epr is set to about −6V, then Vfgr will settle at about +5V, which is the midpoint between the two voltages. If the voltage at Eer is set to about +11V and the voltage at Epr is set to about −11 V, then Vfgr will go to about 0V. If the voltage at Eer is set to about +6V and the voltage at Epr is set to about −16V, then Vfgr will go to about −5V.

As stated earlier, circuit 40 programs both floating gates fgr and fgl during the set mode. Correspondingly, tunnel devices Tpl and Tel similarly operate in dual conduction to modify the charge level on floating gate fgl by allowing electrons to tunnel onto and off of floating gate fgl so as to divide the voltage between nodes 28 and 16 in half. In addition, if circuit 30 is used during the set mode to generate the voltage Vx at node 27 in circuit 40, ideally, the tunnel currents in both circuits 30 and 40 are reasonably well matched, and transistors T13, T14, T15 are reasonably well matched, such that when circuits 30 and 40 settle, Vfgr=Vfgl=VfgØ. Although this condition is preferable, circuit 40 will set Vfgr=Vfgl even where floating gate fgl is not set exactly equal to floating gate fgØ, since floating gates fgl and fgØ are not in the same differential circuit.

Circuit 40 further includes a circuit 430 that compares Vfgr, the voltage on floating gate fgr to Vfgl, the voltage on floating gate fgl, and that generates an output voltage Vout, at node 19, that is a function of the difference between the voltages on floating gates fgr and fgl. Circuit 430 preferably includes a differential amplifier (or differential stage) 432 that is preferably configured to have a non-inverting input coupled to floating gate fgl and an inverting input coupled to floating gate fgr. Circuit 430 further includes a gain stage 434 with an input coupled to node 20 and an output terminal 436, at node 19. The differential stage 432 compares the voltages received at its inputs and amplifies that difference, typically by a factor of 50 to 100. The gain stage 434 then further amplifies that difference by another factor of 50 to 100. Moreover, at the conclusion of the set mode, Circuit 430 ideally settles to a steady state condition, such that Vfgr=Vfgl=Vout.

Circuit 40 also includes a feedback loop coupled between nodes 19 and 15. During the set mode, this feedback loop causes the voltage differential between tunnel electrodes Eer and Epr to be modified by modifying the voltage at node 17 as a function of the voltage at node 19. The feedback loop preferably comprises a level shift circuit, preferably a tunnel device TFl formed between node 19 and a node 24, and a transistor T14, preferably an NMOS transistor, coupled common gate, common drain at a node 25, with its source coupled to node 24. Also included in the feedback loop is a transistor T13, preferably an NMOS transistor, having its gate coupled to node 25, its source coupled to node 17, and thereby to erase tunnel device Ter, and its drain coupled to node 26.

Circuit 40 also preferably includes a circuit 440. Circuit 440 preferably comprises a switch S4 that is preferably a MOS transistor that is coupled between nodes 18 and 19 and a MOS transistor switch S5 coupled between node 18 and an input voltage terminal 450. In the set mode, switch S4 is OFF, and switch S5 is ON such that the input set voltage Vset can be coupled to the bottom plate of steering capacitor Cfgr.

Coupling input voltage Vset to terminal 450 during the set mode enables circuit 40 to program a charge level difference between floating gates fgr and fgl that is a predetermined function of Vset. Thereafter during a subsequent read mode, circuit 40 generates a reference voltage that is a predetermined function of Vset, and is preferably equal to Vset. Specifically, during the set mode, the voltage programmed across capacitor Cfgl is the same as that programmed on floating gate fgl, since Cfgl is preferably coupled to ground during the set mode. Whereas, the voltage programmed across capacitor Cfgr is Vfgr (which is ideally equal to Vfgl) minus Vset. Thereafter, when power and Vset are removed at the conclusion of the set mode, node 18 goes to zero volts and Vfgl remains the same, but Vfgr is equal to the voltage across Cfgr, which is equal to (Vfgl−Vset) Thus, a difference in charge level exists between floating gates fgr and fgl that is equal to the difference in charge remaining on capacitors Cfgl and Cfgr at the conclusion of the set mode. This difference in charge level between fgr and fgl, which is a predetermined function of Vset, is what causes a reference voltage to be generated at node 19 during a read mode for circuit 40 that is a predetermined function of Vset, and is preferably equal to Vset. To produce a voltage reference output equal to Vset, S5 is turned off and S4 is turned on, which connects Vout to node 18, which is coupled to fgr through Cfgr. Vout settles at the voltage where Vfgr=Vfgl, which occurs when node 18=Vset.

Figure 2:
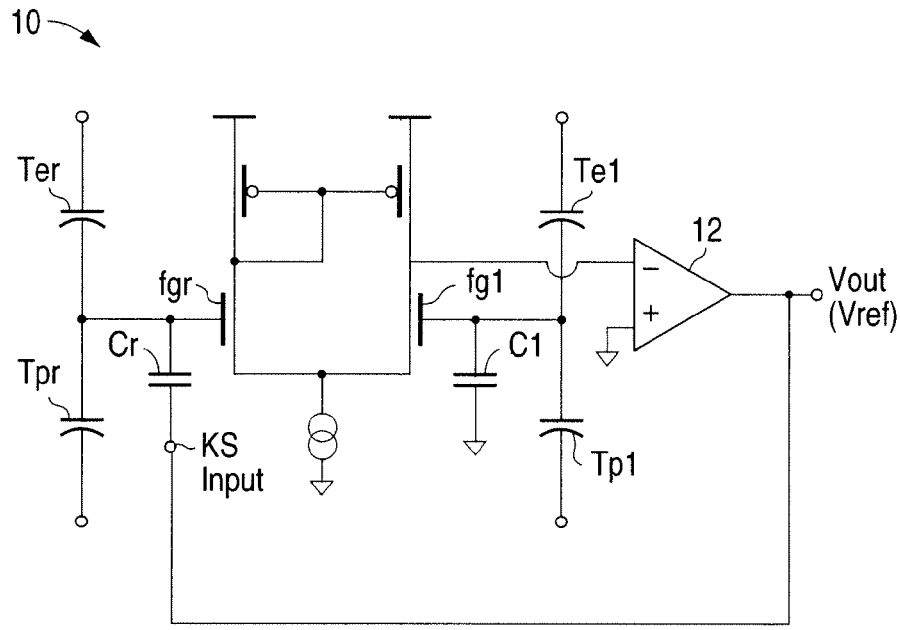
FIG. 2 is a schematic diagram of a dual floating gate voltage reference circuit in a read mode having a single capacitor for each floating gate according to a first preferred embodiment of the present invention.

FIG. 2 is a schematic diagram of a read mode dual floating gate reference circuit 10 having a single capacitor for each floating gate according to an embodiment of the present invention. Reference circuit 10 includes floating gates fgl and fgr. In a dual floating gate reference, the reference voltage is based on the difference in charge levels between two floating gates fgl and fgr. During a nonvolatile set cycle, the voltages on both fgl and fgr are set to the same Set0 voltage while a voltage Vref is capacitively coupled through a capacitor Cr to fgr via an input terminal KS.

FIG. 2 shows the dual floating gate differential circuit in a read mode connected to an op amp 12 whose output is connected to KS which is capacitively coupled to fgr. With this connection, the op amp 12 drives Vout such that Vfgr=Vfgl, which occurs when Vout=Vref. During the read operation of the dual floating gate reference, Vout is connected to the KS input and the amplifier drives Vout to the point where Vfgr=Vfgl(=Set0), which occurs when Vout=Vref. Although Vfgr=Vfgl, importantly, the voltages across capacitor Cl and capacitor Cr are quite different. The voltage across capacitor Cl is Set0 and the voltage across capacitor Cr is approximately Set0−Vref. Since the temperature coefficients of floating gate fgl, i.e., Tcfgl and floating gate fgr, i.e., Tcfgr, are determined primarily by the Tcs of capacitor Cl and capacitor Cr respectively, Tcfgl is different from Tcfgr because the voltages across capacitor Cl and capacitor Cr are different (assuming fgl and fgr have the same design and Vref is not equal to 0). For a given Vref, the voltages across capacitor Cl and capacitor Cr both change with Set0, which in turn changes both Tcfgl and Tcfgr. Thus, it is possible to adjust the Tc of Vout by changing the voltage on Set0 during a set cycle. Using different capacitor types, sizes, and ratios for fgl and fgr it is possible to adjust the Tcfgr and Tcfgl characteristics for a given process such that the Set0 voltage can be used to achieve very low Tc for a range of Vout voltages. This makes it possible to achieve very low Tc on Vout for a wide variety of Vout voltages by simply selecting the Set0 voltage during the set cycle that provides the minimum Tc for any given Vout. The present invention will now be described in further detail.

In order to minimize the Tc of a dual floating gate reference it is important to understand that once the dual gate reference is set, the charge levels of the floating gates are different, but remain constant over temperature. In order to simplify the calculations and show the basic principles of how to design dual floating gate circuits to have minimum Tc, the following assumptions are made:

The charge levels Qfgl and Qfgr on floating gates fgl and fgr are determined during the set cycle by the Vref and Set0 voltages.

The charge levels Qfgl and Qfgr are not the same for any Vref other than 0V. Once the reference is set, the charge levels Qfgl and Qfgr on floating gates fgl and fgr are constant over temperature.

Capacitors Cfgl and Cfgr are approximately equal in order to minimize voltage offsets during a set mode.

Figure 5:
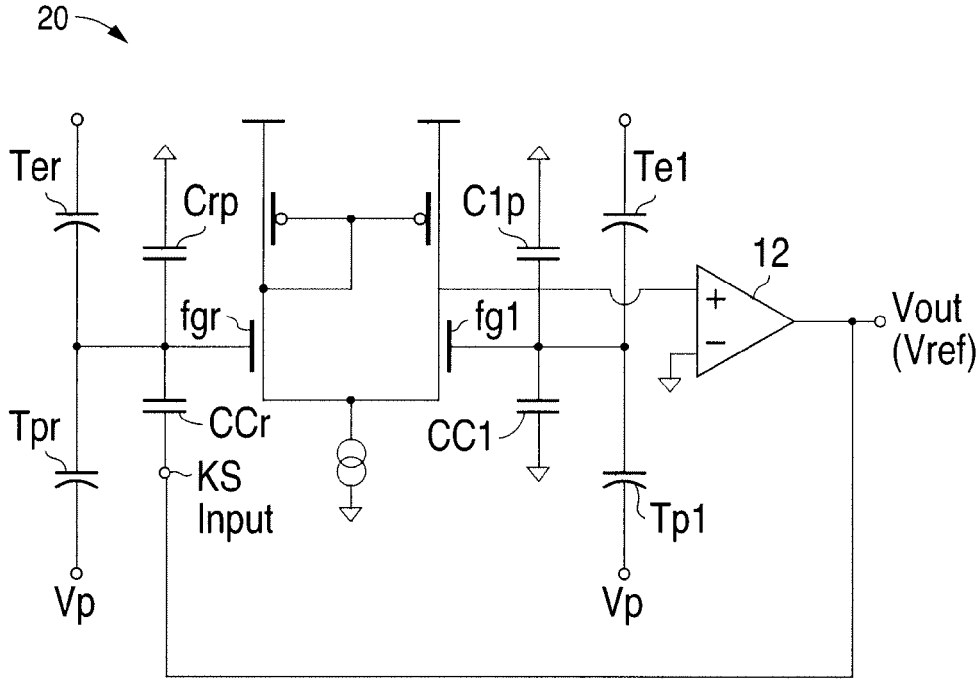
FIG. 5 is a schematic diagram that illustrates a second preferred embodiment of the programmable dual floating gate reference circuit with both N+ and Poly-Poly floating gate capacitors according to the present invention.

The floating gate coupling capacitances, Cr & Cl, shown in FIG. 5, are much larger than the other floating gate capacitances such as the MOS transistor or tunnel device capacitances, such that, to a first order of magnitude, Cfgr=Cr and Cfgl=Cl.

The voltage of a capacitor is V=Q/C.

In order to keep Vout constant in a dual floating gate reference, Vfgl and Vfgr do not have to remain constant, only the difference between Vfgl and Vfgr must remain constant. This means Vfgr and Vfgl have to change the same amount with temperature.

Since the charge levels on fgl and fgr are different, it turns out that Cfgr and Cfgl must change different amounts with temperature in order to maintain the difference between Vfgl and Vfgr constant. This requirement is the key to achieving very low Tc in a dual floating gate reference.

The voltage of a floating gate fg made up of several capacitors is Qfg/Cfg plus the effect of any non-zero voltages coupled to the floating gate by coupling capacitors. For fgl, Vfgl=Qfgl/Cfgl because the other terminal of the coupling capacitor Cl is at ground so no other voltages are coupled to fgl. For fgr, Vfgr=Qfgr/Cfgr+Vref where the effect of the Vref voltage coupling to the floating gate in this simplified case is calculated assuming a 100% coupling ratio (i.e., no other capacitance to ground). During the set cycle, the voltage on each floating gate is set at room temperature, which is 25° C. typically, that is, Vfgl (25° C., i.e., 25 C) and Vfgr (25 C) are established at 25 C. This establishes the charge level on each floating gate at room temperature.

In order to determine the effect of temperature on the dual floating gate reference, first the charge on each floating gate and capacitance at 25 C is calculated. Then, for a new temperature, such as 125 C, new floating gate capacitances, Cfgl (125 C) and Cfgr (125), are calculated at 125 C. The new floating gate voltages at 125 C are then calculated using the new floating gate capacitances, but with the same 25 C charge since the charge level does not change with temperature.

The equations for calculating the charge Q on floating gates fgl and fgr are:

1. Qfgl(25 C)=Vfgl×Cfgl(25 C)=Set0×Cfgl(25 C), where Vfgl=Set0 is the voltage on Set0 input during the set cycle to which the setting circuitry sets both Vfgl and Vfgr.
2. Qfgr(25 C)=Cfgr(25 C)×(Vfgr−Vref), where Vfgr=Vfgl=Set0 is the voltage on Set0 input during the set cycle to which the setting circuitry sets both Vfgr and Vfgl; and Vref is the voltage on the N+ plate of coupling capacitor Cr to fgr which during normal operation is the output voltage, Vout, of the reference.

The basic equations for voltages on floating gates fgl and fgr at 125 C are:

3. Vfgl(125 C)=Qfgl(25 C)/Cfgl(125 C)
4. Vfgr(125 C)=Qfgr(25 C)/Cfgr(125 C)+Vref(125 C)

The above equations are used to obtain the values shown in the chart/spreadsheet in FIG. 4 for the circuit in FIG. 2, with a basic linear model for capacitance vs. temperature for Cl and Cr, to show the concept of how the common mode voltage Set0 can be used to adjust the Tc of a dual floating gate voltage reference.

Figure 3A:
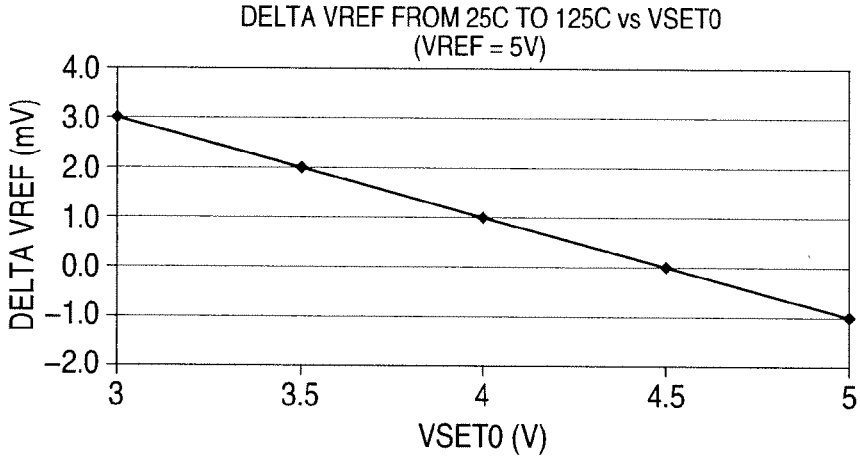
FIG. 3A is a graph of Delta Vref versus Vset0 for the floating gate reference circuit of FIG. 2 with Vref=5 Volts.
Figure 3B:
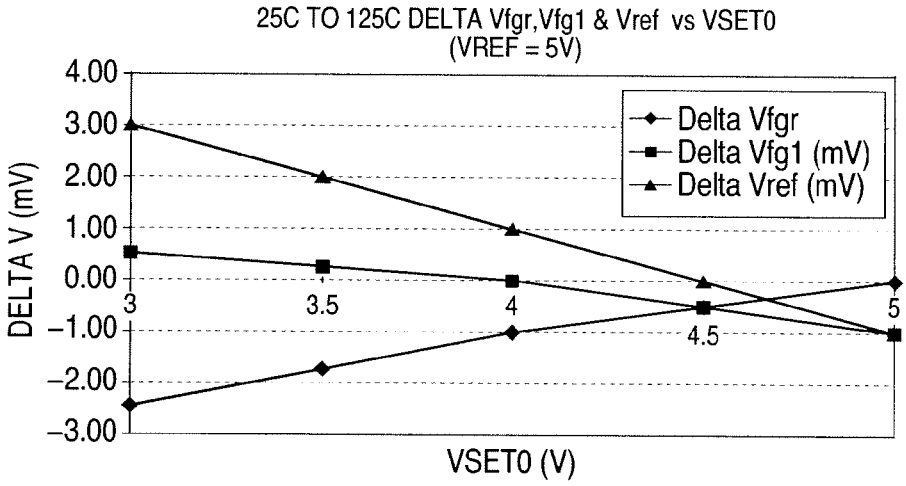
FIG. 3B is a graph of Delta Vfgr, Delta Vfgl, and Delta Vref versus Vset0 for the floating gate reference circuit of FIG. 2 with Vref=5 Volts.
Figure 3C:
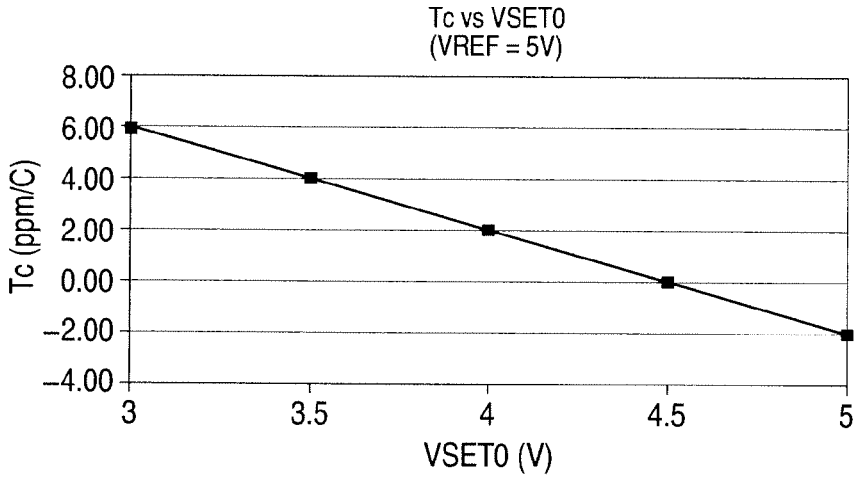
FIG. 3C is a graph of Tc versus Vset0 for the floating gate reference circuit of FIG. 2 with Vref=5 Volts.
Figure 3D:
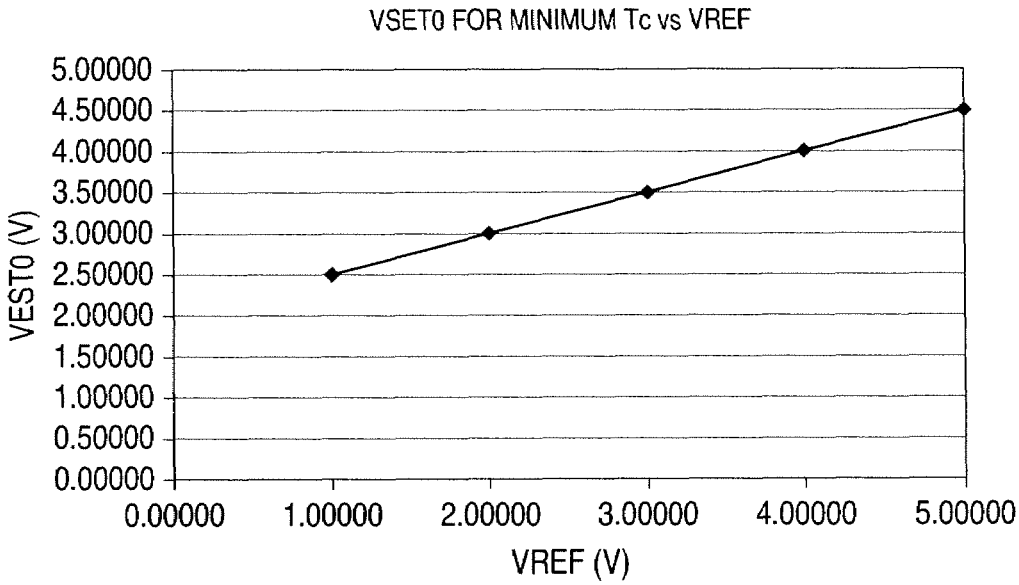
FIG. 3D is a graph of Vset0 for the Minimum Tc versus Vref for the floating gate reference circuit of FIG. 2.

The graphs in FIGS. 3A-3D are derived from the spreadsheet in FIG. 4. FIG. 3A is a graph of Delta Vref versus Vset0 for the floating gate reference circuit of FIG. 2 with Vref=5 Volts. FIG. 3B is a graph of Delta Vfgr, Delta Vfgl, and Delta Vref versus Vset0 for the floating gate reference circuit of FIG. 2 with Vref=5 Volts. FIG. 3C is a graph of Tc versus Vset0 for the floating gate reference circuit of FIG. 2 with Vref=5 Volts. FIG. 3D is a graph of Vset0 versus Vref for the Minimum Tc for the floating gate reference circuit of FIG. 1. Although FIGS. 3A-3D show plots for an exemplary reference voltage, Vref, of 5V, the present invention may be used to reduce Tc for a range of Vrefs.

The chart/spreadsheet in FIG. 4 shows the Tc calculations for various Vref and Vset0 voltages. Rows 4 through 10 show the Tc for a representative N+ capacitor which varies linearly from −10 ppm/C at Vcap=−1V to +2 ppm/C at Vcap=5V. Row 11 shows the linear equation for the N+ Cap Tc is Tc=(2×Vc)−8 ppm/C. Row 13 shows the equation for calculating the capacitance of a N+ Cap as a function of temperature using the Tc from Row 11: C(25 C+DelT)=C(25 C)×(1+(Tc×DelT×1E−6)) where C(25 C) is the capacitance at a temperature of 25 C and C(25+DelT) is the capacitance at a second temperature of 25 C+DelT where DelT is the difference between the second temperature and 25 C. This equation is used in Columns G and H to calculate the capacitance of Cfgr and Cfgl. In Rows 18 through 61, Column A shows the 25 C Vref voltage and Column B shows the 25 C Vset0 voltage chosen to provide various combinations of Vref from 1V to 5V and Vset0 from 2.5V to 5V. 3 rows are used to calculate Tc for each Vref & Vset0 combination. For example, Rows 34 through 36 show a Tc calculation for Vref=5V (34A using a short hand representation for row 34 and column A) and Vset0=4.5V (34B). Column C shows the temperature, either 25 C for Row 34 or 125 C for Row 35. Column D calculates the temperature delta (DelT) between 25 C and a second temperature, which in this case is 125 C. DelT in 34D is 0 because Row 34 is at 25 C. DelT in 35D is 125−25=100 because Row 35 is at 125 C. Tc for Cr is calculated in Column E using the Tc equation from Row 11 with Vcr=Vset0−Vref because Vfgr−Vset0 and KS=Vref. In this example, Vcr=Vset0−Vref=4.5V−5V=−0.5V so Cr Tc=(2×−0.5)−8=−1−8=−9 ppm/C as shown in 35E. Similarly the Tc for Cl is calculated in Column F using the Tc equation from Row 11 with Vcl=Vset0. Vcl=4.5V so Cl Tc=(2×4.5)−8=+9−8=+1 ppm/C as shown in 35F. Cells 34G and 34H show the 25 C floating gate capacitances Cfgr and Cfgl which are both chosen to be 10 pF in this example. Also in this example it is assumed the floating gate capacitances are N+ Cap capacitors only so Cfgr=Cr and Cfgl=Cl. Once Cfgr and Cfgl are defined at 25 C, the appropriate Tc values from 35E and 35F are used with the equation in Row 13 to calculate Cfgr and Cfgl at 125 C.

Cfgr=10 pF×(1−9×100×1E−6)=10 pF×0.9991=9.991 as shown in 35G. Cfgl=10 pF×(1+1×100×1E−6)=10 pF×1.0001=10.001 pF as shown in 35H. Next the charge Qfgr on fgr and Qfgl on fgl at room temperature are calculated in Columns I and J using Q=CV.

Qfgr=Cfgr×Vfgr=10 pF×(Vset0−Vref)=10 pF×(−0.5V)=−5 p Coulombs as shown in 34I. Qfgl=Cfgl×Vfgl=10 pF×Vset0=10 pF×4.5V=45 p Coulombs as shown in 34J. Since the charge on a floating gate does not change with temperature, the same Qfgr and Qfgl are shown in 35I and 35J for charge at 125 C. Now the voltages across Cfgr and Cfgl are calculated in Column K and Column L respectively for both 25 C and 125 C using the capacitance and charge values calculated in Columns G, H, I and J. Of course at 25 C, Vcfgr=−0.5V and Vcfgl=4.5V since those were the initial starting values. At 125 C, Vcfgr=Qfgr/Cfgr=−5 pC/9.991 pF=−0.5005V as shown in 35K and Vcfgl=45 pC/10.001 pF=4.4996V as shown in 35L. Now the change in Vcfgr and Vcfgl (in mV) from 25 C to 125 C is calculated in 36K=Delta Vcfgr=1000×(34K−35K) and 36L=Delta Vcfgl=1000×(34L−35L). Note that both Vcfgr and Vcfgl decrease by about 0.45 mV. 36M shows the difference between the change in Vcfgr and Vcgfl=Delta Vcfgr−Delta Vcfgl=0.0005 mV. In 36N, the box Tc from 25 C to 125 C is calculated (in ppm/C) using Tc(box)=1000×(Delta Vcfgr−Delta Vcfgl)/(DelT×Vref)=1000×(0.0005)/(100×5)=0.5/500=~0 ppm/C. It is very instructive to note that the Tc is approximately 0 because the voltages across Cfgr and Cfgl both decreased the same 0.45 mV. Since Vref in the dual floating gate reference is based on the difference in voltages across Cfgr and Cfgl, and since both of these voltages decrease the same amount with temperature in this example, Vref remains nearly constant over temperature.

Other rows in the spreadsheet show the same calculations for different Vset0 and Vref voltages for temperatures of 25 C and 125 C. These calculations are plotted in FIGS. 3A-3C and show the Vset0 voltage can be used to adjust the Tc either positive or negative for Vref=5 Volts. FIG. 3C shows the Vset0 voltage allows a variety of Vref voltages to be made with very low Tcs by selecting the appropriate Vset0 voltage to achieve the minimum Tc.

Referring to FIG. 3B, the data for the graph in FIG. 3B is from columns K and L in the spreadsheet in FIG. 3 and shows the change in various voltages in the dual floating gate reference circuit in FIG. 2 over temperature for various Set0 voltages. The graph shows how the two floating gate voltages change different amount from 25 C to 125 C, depending on the Set0 voltage for a 5V Vref. As can be seen in FIG. 3B, in this example, from +25 C to +125 C, DeltaVfgl is +0.6 mV at VSet0=3V and decreases to −1 mV at Vset0=5V. DeltaVfgr changes from −2.4 mV at VSet0=3V to 0 mV at VSet0=5V. DeltaVfgl=DeltaVfgr=−0.45 mV at Vset0=4.5V. Tc=0 when DeltaVref=0. Delta Vref=0 when DeltaVfgl=DeltaVfgr which for this case occurs at VSet0=4.5V where both floating gates change the same amount (−0.45 mV). Thus, in this example, the minimum Tc, Tc=0, is achieved in the dual floating gate reference by setting Vset0 to 4.5V.

FIG. 5 is a schematic diagram that illustrates a second preferred embodiment of the programmable dual floating gate reference circuit according to the present invention. As seen in FIG. 5 the circuit 20 includes an additional voltage variable capacitors, Crp and Clp respectively, for each floating gate which represents the poly-poly capacitance for each floating gate. FIG. 6 is a corresponding spreadsheet/chart of Tc model data in parts per million (ppm) for the floating gate reference circuit of FIG. 5.

As described above, a typical floating gate EEPROM technology has 2 layers of polysilicon as well as an N+ diffusion coupling capacitor to the floating gate. In one EEPROM technology, the Tc of the poly-poly capacitor is about 20 ppm/deg C and the voltage coefficient is nearly 0. The Tc of one type of N+ diffusion to floating gate capacitor varies from 40 ppm/C to +0 ppm/C for DC voltages from 0 to +6 volts and the Vc is positive and varies from 100 to 10 ppm per volt in the 0 to +6 volt range.

Figure 7:
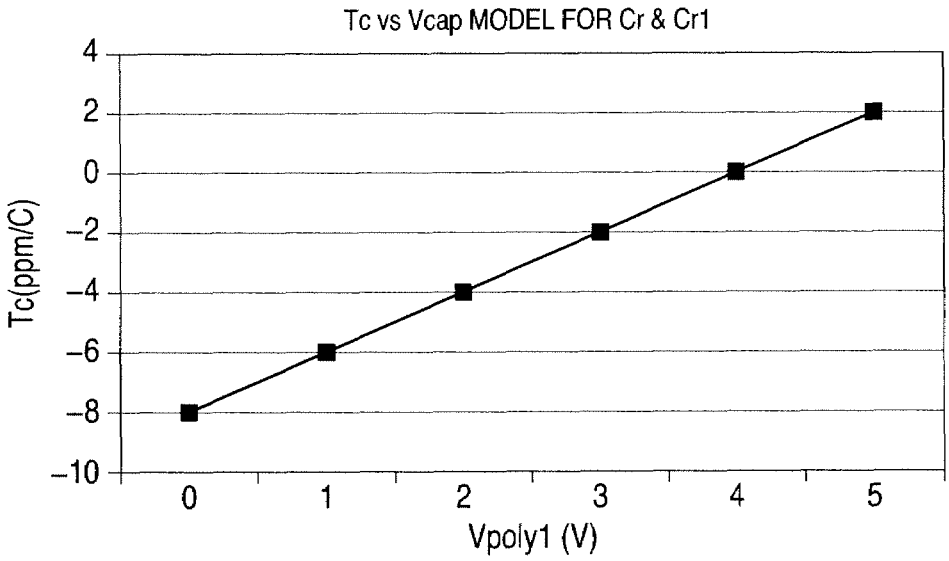
FIG. 7 is a graph of Vpoly1 vs Tc for a Tc vs Vcap model for Cr and Cl.

FIG. 7 is a graph of Vpolyl vs Tc for a Tc vs Vcap model for Cr and Cl. For a simplified N+ cap Tc model, Tc is 2*Vcap−8 ppm/C. For a PolyCap Tc model, Tc is about +20 ppm/C. For the Tc spreadsheet model, C(25+Delta T)=C(25)×(1+10−6×Tc×Delta T).

Although specific embodiments of the invention have been described, various modifications, alterations, alternative constructions, and equivalents are also encompassed within the scope of the invention. The described invention is not restricted to operation within certain specific data processing environments, but is free to operate within a plurality of data processing environments. Additionally, although the invention has been described using a particular series of transactions and steps, it should be apparent to those skilled in the art that the scope of the invention is not limited to the described series of transactions and steps.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. In a dual floating gate voltage reference circuit having two floating gates for storing charge thereon, one or more capacitors coupled to one of said floating gates, and one or more other capacitors coupled to the other of said floating gates, wherein a voltage reference output (Vref) is generated as a function of the difference in charge on said floating gates and wherein the temperature coefficient, Tc, of said voltage refrrence output is substantially a function of the temperature coefficient of said capacitors, a method for improving the accuracy of Vref as a function of temperature, comprising:

causing each of said floating gates to change voltage substantially the same amount as a function of temperature by causing the voltages on said capacitors coupled to each of said floating gates to change different amounts with temperature to substantially reduce the temperature coefficient, Tc, of said voltage reference output.

2. The method of claim 1, wherein the step of causing each of said floating gates to change voltage substantially the same amount as a function of temperature futher comprises:

selecting a desircd Vref, wherein Vref is any voltage in a predetermined range;

determining a common mode voltage (Set0 voltage) for said selected Vref such that the temperature characteristics of each floating gate are substantially matched; and using said Set0 voltage in a set mode of said voltage reference circuit.

3. The method of claim 1, wherein the Tc of said voltage reference output is less than 1 ppm per degree C.

4. The method of claim 1, wherein the Tc of said voltage reference output is less than 10 ppm per degree C.

5. The method of claim 1, wherein the step of causing each of said floating gates to change voltage substantially the same amount as a function of temperature further comprises adjusting the capacitance ratios of the capacitors coupled to one or both of said floating gates.

6. The method of claim 2, further comprising the step of adjusting said one or more capacitors coupled to each of said floating gates so as to reduce Tc for Set0 voltages in a preselected range and for a Vref in a preselected range.

7. The method of claim 6, wherein said adjusting step comprises adjusting the size of one or more of said capacitors.

8. The method of claim 6, wherein said adjusting step comprises adjusting the type of said capacitors.

9. The method of claim 6, wherein at least two capacitors are coupled to each of said floating gates and said adjusting step comprises adjusting the relative size ratios of the two capacitors coupled to each floating gate.

10. The method of claim 1, wherein each floating gate has one capacitor coupled thereto and the capacitance of each of said capacitors is about equal.

11. A dual floating gate reference circuit for improving the accuracy of a voltage reference output ($V_{ref}$) as a function of temperature, wherein Vref is generated as a function of the difference in charge on said floating gates, comprising:

a first floating gate for storing charge thereon;

a second floating gate for storing charge thereon;

a first capacitor coupled to said first floating gate;

a second capacitor coupled to said second floaiing gate;

wherein said reference circuit is arranged such that said first and second floating gates are programmable by said first and second capacitors, respectively, during a set mode by causing the voltages on said capacitors coupled to each of said floating gates to change different amounts with temperature so as to cause each of said floating gates to change voltage substantially the same amount as a function of temperature to substantially reduce the temperature coefficient, Tc, of said voltage reference output.

12. The circuit of claim 11, wherein said reference circuit enables the setting of a selected Vref, wherein Vref is any voltage in a predetermined range; and wherein said reference circuit includes a circuit for generating a common mode voltage (Set0 voltage) for said selected Vref such that the temperature characteristics of each floating gate are substantially matched.

13. The circuit of claim 11, wherein said capacitors coupled to each of said floating gates are adjusted so as to cause each of said floating gates to change voltage substantially the same amount as a function of temperature.

14. The circuit of claim 11, wherein said capacitors coupled to each of said floating gates are adjusted so as to reduce Tc for Set0 voltages in a preselected range and for a Vref in a preselected range.

15. The circuit of claim 14, wherein the sizes of one or more of said capacitors are adjusted.

16. The circuit of claim 14, wherein the types of one or more of said capacitors are adjusted.

* * * * *